US007458410B1

(12) United States Patent
Bronner

(10) Patent No.: US 7,458,410 B1
(45) Date of Patent: Dec. 2, 2008

(54) MULTIPLE DOOR JOINING ASSEMBLY

(76) Inventor: Dan Bronner, P.O. Box 3782, Manhattan Beach, CA (US) 90266

( * ) Notice: Subject to any disclaimer, the term of this patent is extended or adjusted under 35 U.S.C. 154(b) by 294 days.

(21) Appl. No.: 10/974,601

(22) Filed: Oct. 27, 2004

Related U.S. Application Data

(60) Provisional application No. 60/525,155, filed on Nov. 28, 2003.

(51) Int. Cl.
*E05D 15/06* (2006.01)

(52) U.S. Cl. ..... 160/197; 160/214; 160/208

(58) Field of Classification Search ..... 160/214, 160/197, 200, 202, 208, 222, 226, 227, 228, 160/37, 22, 43; 49/427, 411, 455, 414, 426
See application file for complete search history.

(56) References Cited

U.S. PATENT DOCUMENTS 185,499 A * 12/1876 Conroy ..... 49/411
2,833,346 A * 5/1958 Preston ..... 160/197
2,895,183 A * 7/1959 Dumbolton ..... 160/197
3,100,916 A * 8/1963 McKinney ..... 49/125
4,305,227 A * 12/1981 Georgelin ..... 49/141
4,785,485 A * 11/1988 Etesam ..... 4/557
5,417,272 A * 5/1995 Marlowe et al. ..... 160/202
5,832,980 A * 11/1998 Cianciolo ..... 160/197
6,684,932 B2 * 2/2004 Olofsson ..... 160/214

* cited by examiner

*Primary Examiner*—Blair M. Johnson
(74) *Attorney, Agent, or Firm*—Lauson & Schewe LLP; Robert J. Lauson

(57) ABSTRACT

A joining assembly for "ganging" respective doors together such that by movement of one door causes the other doors to follow. A connecting plate and a spacer plate is screwed to the bottom of a primary door while the connecting plate includes a cam follower to ride in a groove in the bottom of a first secondary door. In this manner, both doors are "ganged" together. If other secondary doors are required to be joined with the previous two doors, a connecting angle plate is employed for securing to the secondary door so as to guide the third, fourth, etc. doors. A guide stop, hinge floor guide, and cam follower assembly is mounted to the last door in the multi-door series and the cam follower "tracks" in a floor guide hidden in a "pocket" when a storage pocket is employed in the installation. By ganging these doors, stability is imparted by the weight and mass of the doors.

15 Claims, 3 Drawing Sheets

10
11
12
13
14
15
16
17
18
19
20
21
22
23
24
25
26
27
28
30
31
32
33
34
35
36
37
40
41
42
43
44
45
46
47
48
4

FIG. 4
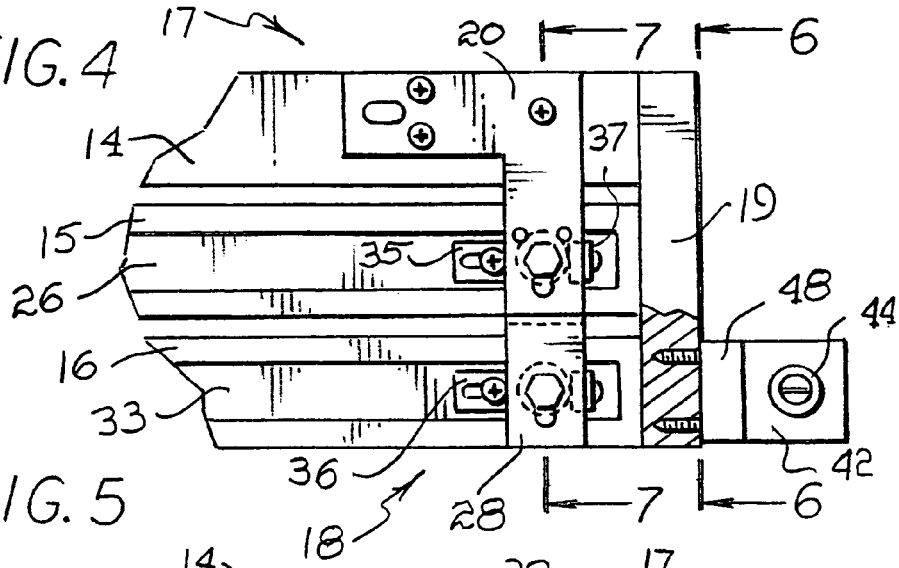
FIG. 5
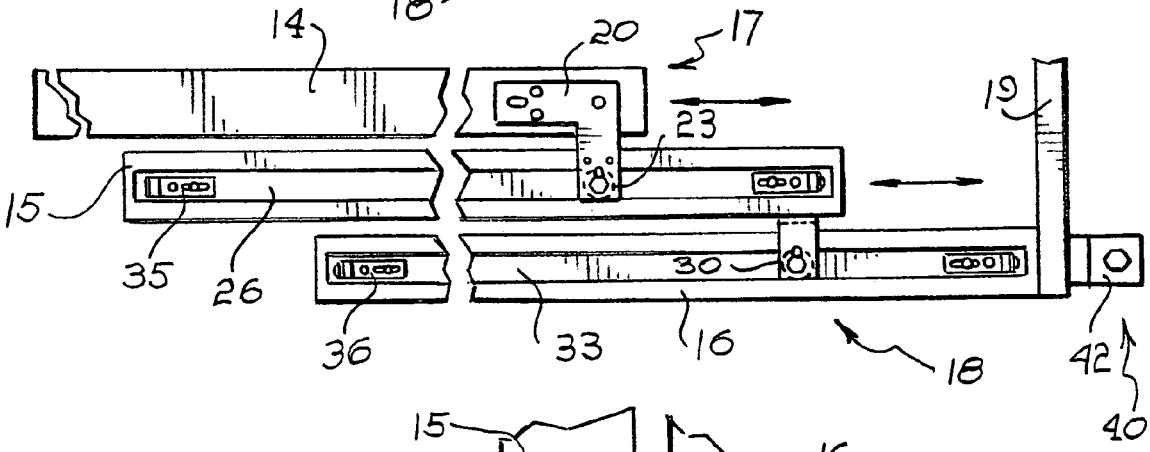
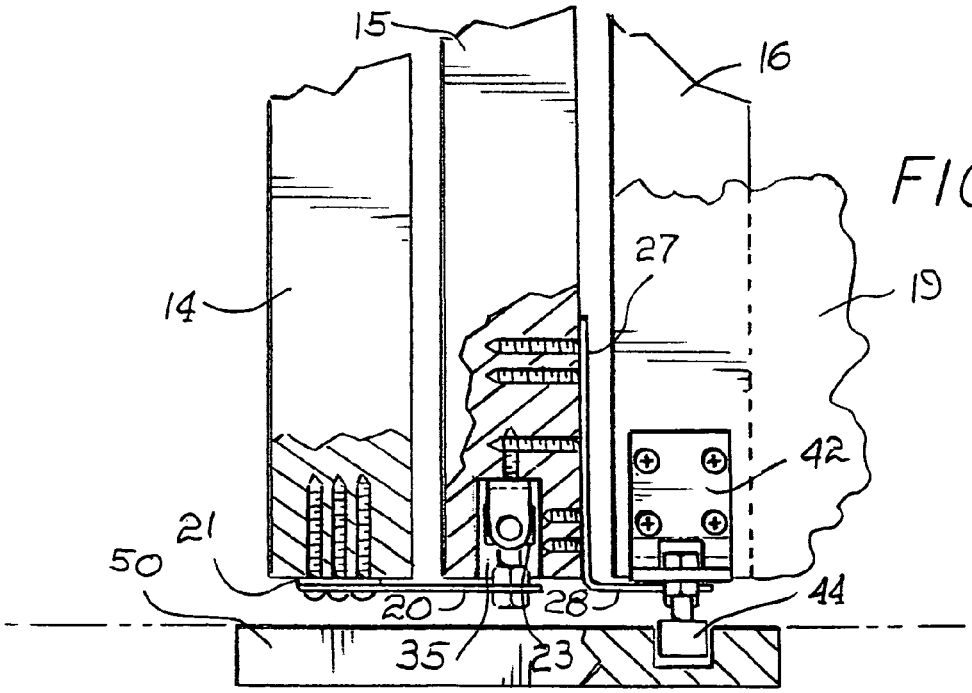
FIG. 6

MULTIPLE DOOR JOINING ASSEMBLY

Priority Claimed on Ser. No. 60/525,155 filed Nov. 28, 2003

BACKGROUND OF THE INVENTION

1. Field of the Invention

The present invention relates to the field of multiple door joining or attachment assemblies and more particularly to such an attachment assembly that allows the joining and stabilizing of two or more doors with or without a floor mounted track so that when a primary door is moved, a secondary door or doors will follow as well.

2. Brief Description of the Prior Art

Conventionally, multiple door installations, such as pocket doors and multi-slide door units, require a track located in the floor below the doors to guide and stabilize the doors as the doors are opened or closed. If this track is not present, the doors are allowed to swing independently with respect to each other which raises several problems. One of the problems resides in that the doors are allowed to swing or bang with respect to each other and the doors may also swing out of the normal straight or "plumb" line of travel. Furthermore, each door must be moved independently into a desired location with respect to the other doors and unnecessary impacting of the doors is experienced during their sliding operation.

Therefore, a long-standing need has existed to provide multi-door pull/push hardware or joining assemblies which attaches two or more secondary doors to a primary door so that a bottom floor track is unnecessary and wherein the multiple doors will not be free to swing or bang against each other.

SUMMARY OF THE INVENTION

Accordingly, the above problems and difficulties are avoided by the present invention which provides a joining hardware assembly for "ganging" their respective doors together such that by pulling or pushing on one door causes the other doors to follow. The "ganging" of the doors together employs a connecting plate and a spacer plate screwed to the bottom of a primary door while the connecting plate includes a cam follower or bearing located in such a manner as to ride in a groove in the bottom of a first secondary door. In this manner, both doors are "ganged" together. If a third or second secondary door is required to be joined with the previous two doors, a connecting angle plate is employed for securing to the secondary door so as to guide the third, fourth, etc. doors. A guide stop, hinge floor guide, and cam follower assembly is mounted to the last door in the multi-door series and the cam follower of this assembly "tracks" in a floor guide which is hidden in a "pocket" when a storage pocket is employed in the installation. This guides a door unit in a normal straight and "plumb" line of travel for door unit systems which are not enclosed in a "pocket" where no hidden track is used. However, by ganging these doors together stability is imparted by the weight and mass of the doors. Special bump bracket assemblies are installed in the head track and in the dados or grooves of the doors to stop the doors in the required location.

Therefore, it is among the primary objects of the present invention to provide self-aligning of multiple doors throughout a full range of operation, either with or without floor guide tracks.

Another object of the invention is to provide multi-door pull/push hardware for joining the doors together permitting minimal lateral door movement during operation of the doors.

Still a further object resides in providing a plurality of doors together which are moved out of a storage position into an operable position in unison whereby the doors are "ganged" together so that by pulling or pushing on one door, the other doors will also be moved.

Another object resides in providing a multiple sliding door system having a door connecting or joining assembly that permits simultaneous operation of the doors without the necessity of a floor track.

A further object resides in a multiple sliding door system that employs plate connection plates coupling the doors together so as to move along a head track without the need for a floor track.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 4 is a sectional view of the hardware assembly shown in FIG. 2 as taken in the direction of arrows 4-4 thereof;

FIG. 5 is a bottom or underside view of the multi-door installation shown in FIG. 3;

FIG. 6 is a sectional view taken in the direction of arrows 6-6 of FIG. 4;

DESCRIPTION OF PREFERRED EMBODIMENT

Figures 1, 2, 3:
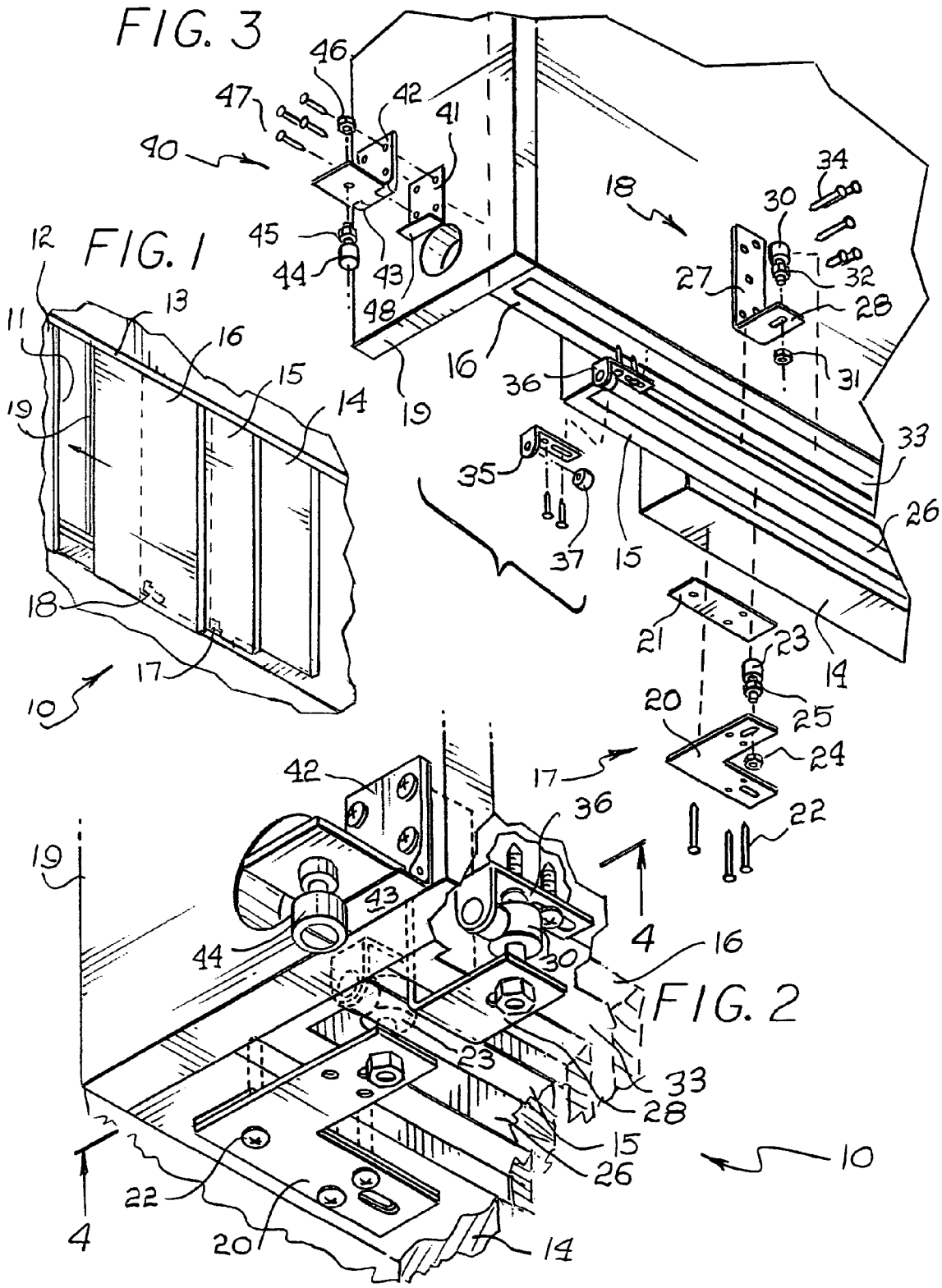
FIG. 1 is a reduced, perspective view illustrating a multi-door installation incorporating the present invention.
FIG. 2 is a bottom view of the inventive joining or attachment hardware assembly attaching the multi-doors together as used in the installation shown in FIG. 1.
FIG. 3 is an exploded underside view of the multiple door arrangement including hardware assembly shown in FIG. 2.

Referring to FIG. 1, the novel multi-door push/pull hardware incorporating the present invention is illustrated in the general direction of arrow 10. Typically, multi-slide door units are stored in a pocket 11 within a wall 12 of a dwelling. The door units require a head track 13 mounted in the wall 12 from which the door units downwardly depend. The door units include rollers (not shown) carried in the track 13 and the door units are identified as a primary door 14, which represents the door that is first pulled outward from the pocket 11. Secondary doors 15 and 16 are "ganged" with the primary door 14 so that as the primary door 14 is pulled along the head track 13, the secondary doors will follow in sequence and unison. It is to be particularly noted that the door units are rollably suspended from the head track 13 and there is no floor or bottom track to which the bottom of the door units are secured or stabilized. Normally, in the absence of a floor track, the door units will be allowed to swing independently of each other which causes problems as set forth above. Since the doors are independent of each other and are without a floor guide track, hardware assembly is required to "gang" the door units together such that by pulling or pushing on one door, the other doors will follow. Such hardware incorporating the present invention is indicated in the general direction of arrow 10, which includes a connecting plate assembly 17 and an angle connecting plate assembly 18. The connecting plate assembly 17 movably couples the primary door 14 to the first secondary door 15 and the angle connecting plate assembly 18 couples the first secondary door 15 to the second secondary door 16. A close-off panel 19 is secured to the back edge of the second secondary door 16 and serves as a stop for doors 14 and 15 when all of the doors are in the pocket 11.

Referring now in detail to FIGS. 2 and 3, it can be seen that the connecting plate assembly 17 includes an L-shaped plate 20 and a spacer plate 21 which are secured to the underside of the primary door 14 by means of nails or other fasteners, such as indicated by numeral 22. Also, it is to be noted that one arm of the L-shaped plate 20 mounts a cam follower, such as a roller 23, by means of a fastener 24 attached to a shank rotatably mounting the roller 23. A nylon insert 25 is included in the assembly and is mounted on the shank which engages with the nut 24 for securement within an elongated slot on the arm of connecting plate 20. The cam follower 23 is inserted into an elongated groove 26 in the bottom edge of the first secondary door 15. The angle connecting plate assembly 18 includes an angle plate 27 having a right angled leg 28 which mounts a cam follower or roller 30 by means of a shank and fastener 31 as well as an insert 32 as previously described with respect to the connector plate assembly 17. The angle connecting plate 27 is secured to the side of door 15 adjacent to the opposing side of follower or roller 30 is inserted into a groove 33 on the underside of door 16. Nails or other fasteners as indicated by numeral 34 are employed for securing the angle connecting plate to door 15. It is also to be noted that bumper brackets 35 and 36 include bumper pads, such as pad 37, and are secured at the very end of slots 26 and 33 respectively.

A guide assembly is indicated in the direction of arrow 40 and is useful during installation for alignment purposes. The guide assembly includes a guide stop 41 and a hinged floor guide 42 which are both secured to the outside of the close-off panel 19. A hinge 43 movably connects a roller portion of the guide to a fixed portion and the roller portion includes a downwardly depending cam follower 44 having a nylon insert 45 which is fastened to the hinged guide by a fastener including nut 46. Nails 47 fixedly secure the fixed portion of the hinged guide plate and the stop plate to the close-off panel 19. The guide stop 41 includes a stop portion 48 which stops lowering movement of the roller portion of the plate which carries the cam follower 44. The cam follower 44 is placed into a floor guide (not shown in FIG. 3) for alignment purposes during installation.

Referring now to FIG. 4, it can be seen that the bumper brackets 35 and 36 reside at the end of grooves 26 and 33 respectively and that the connecting plate 20 is attached to the primary door 14 so that roller 23 resides in groove 26 while the angle connecting plate 18 is secured to the first secondary door 15. Portion 28 of the angle connecting plate 18 resides under the door 16 so that its respective cam follower 30 can travel within the groove 33.

Referring now to FIG. 5, it can be seen that the doors may be separated from one another; however, they do travel in unison when the primary door is first actuated in either direction as the double headed arrow indicates. Bumper brackets reside at opposite ends of the respective grooves 26 and 33 while cam followers or rollers 23 and 30 reside within their respective grooves.

Referring now to FIG. 6, it can be seen that the guide stop, hinge floor guide and cam follower 44, as an assembly, is secured to the last door in the series, which is the second secondary door 16. The cam follower 44 of this assembly "tracks" in a floor guide 50 which is hidden in the floor under pocket 11. This guides the door unit system in a normal straight and "plumb" line of travel. For door unit systems that are not enclosed in a "pocket", no hidden track is used. By ganging these doors together, stability is imparted thereto by the weight and mass of the doors. The bumper bracket assemblies may be installed in the head track as well as in the grooves of the doors to stop the doors in the required location.

Figure 7:
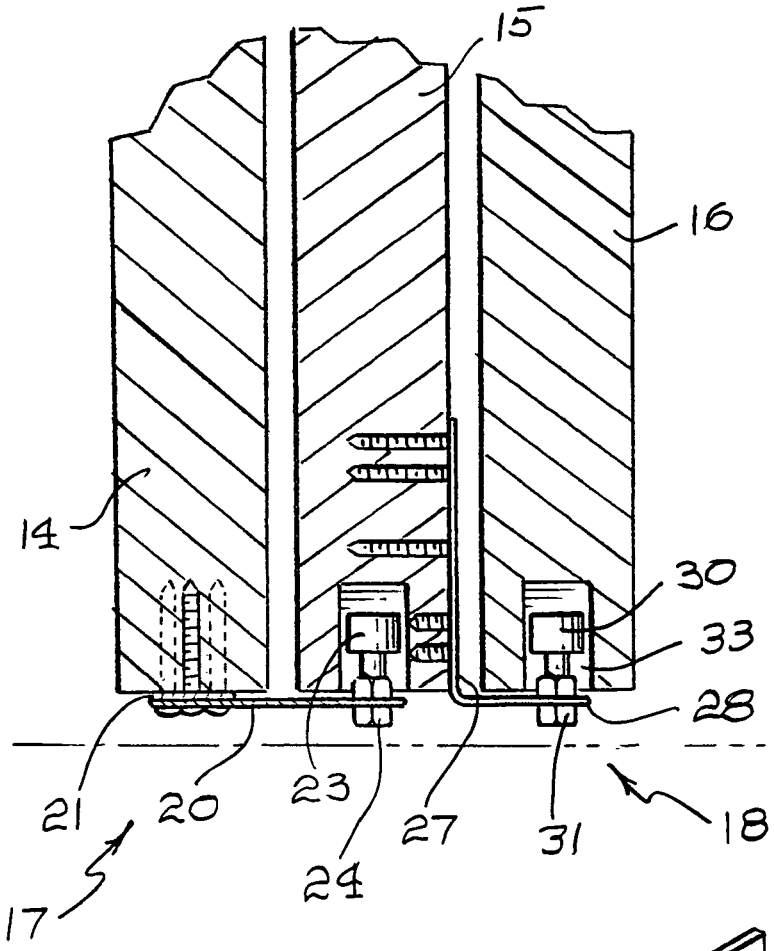
FIG. 7 is a sectional view of the hardware assembly illustrated in FIG. 4 as taken in the direction of arrows 7-7 thereof.

Referring to FIG. 7, it can be seen that the angle connecting plate 27 is attached to the surface of the first secondary door 15 which opposes the primary door 16. The bottom edge marginal region of each door is trimmed so that when the assemblies 17 and 18 are secured to the respective doors, suitable clearance is provided between the underside of the doors and the flooring.

Figure 8:
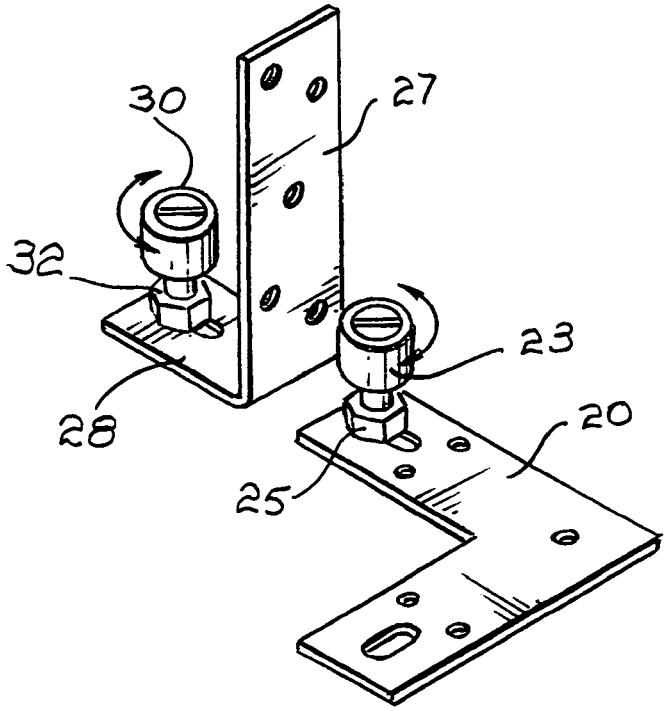
FIG. 8 is a perspective view of the basic connector plate and angle connector plate used in the installation shown in FIGS. 2-7 respectively.

FIG. 8 is a perspective view that shows the counter-rotation of the rollers on the cam followers 23 and 30 respectively. The cam followers are fastened to their respective plates through elongated slots so that adjustment can be made for clearance within the respective door grooves in which they are inserted.

In view of the foregoing, it can be seen that the multi-door push/pull hardware incorporating the present invention provides a novel means for providing stability between a plurality of sliding doors arranged next to each other. First, the installer will determine which door is to be considered the primary door, which is the door an occupant wishes to pull out first and then deciding which doors will be secondary. Next, the installer determines the door thickness and the spacing between the doors and then will cut all door height so that the cam follower fasteners and assemblies will clear the finished floor (see FIGS. 6 and 7). The installer will then place the cam followers, including their rollers, in the appropriate grooves or slots at particular locations on the connecting plate 20 and/or on the angle connecting plate 28, if applicable, and then tighten the fasteners to securely install the assemblies on the respective doors. Next, the installer will assemble the doors so that the respective cam followers will be placed in respective grooves. Also, spacer plates and connecting plate or the angle connecting plate on the primary doors may be used. The close-off panel 19 is secured on the trailing edge of the second door as illustrated in FIGS. 4, 5, and 6. Next, the installer will secure the guide stops and the hinged floor guide on the close-off panel 19 so that the cam follower 44 will rest on the guide stop and be slightly above the bottom of the groove as illustrated in FIGS. 4 and 6. Next, track bumpers are installed on the side of the close-off panel as required to stop the door in a desired location.

The floor area within the "pocket" 11 is required to be level and flush with the finish surface in the front of the pocket opening. The pocket filler is indicated by numeral 50 and includes a groove to accommodate roller 44, as shown in FIG. 6. Next, the installer hangs the second secondary door with the close-off panel 19 from the head track 13 and pushes it back into the pocket 11 by a few inches. Next, confirmation is made that the hinged floor guide is "tracking" the groove cut into the filler 50 which was installed on the pocket floor. (See FIG. 6).

For a two door installation as illustrated, the installer hangs the primary door 14 from head track 13 and adjusts for the correct clearance from the finished floor as in FIG. 6. Then, work is started back through the door system by lowering the second secondary door 15 over the connecting plate cam follower on the primary door so that the clearance to the finish floor is correct as in FIGS. 6 and 7. Next, the second secondary door is lowered with the close-off panel 19 over the angle connecting plate cam follower on the first secondary door so that the clearance to the finish floor is correct as in FIGS. 6 and 7. All doors are adjusted to be plumb and true with each other and the correct distances off the finish floor (again see FIG. 6). Push the door assembly into the pocket 11 for storage. In operation, the user pulls the primary door out of the pocket to the desired location. This action will pull the secondary doors out as well. It is confirmed that the cam followers in the respective grooves are in contact with their corresponding lower bumper assemblies. During installation, the location of the head track bumper assemblies are marked out and the doors pushed back into the pocket during installation.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A multiple door joining assembly comprising:

a plurality of doors having a primary door and at least one secondary door movably suspended to be movable along a longitudinal direction;

a first connecting plate assembly secured to said primary door and having a cam follower outwardly projecting laterally to terminate with an upwardly projecting roller; and said at least one secondary door having a groove in a bottom thereof slidably accepting said roller so that sliding of the primary door in the longitudinal direction actuates sliding motion of the at least one secondary door in the longitudinal direction when the roller contacts an end of said groove in the at least one secondary door;

said secondary door having an installation aid fixedly secured to an outer edge thereof, at least a portion of the installation aid remaining reversibly extendable between retracted and extended positions to in the extended position engage a guide member for guiding the secondary door during the sliding movement, the installation aid having a guide member-engaging portion longitudinally offset from said primary and secondary doors.

2. The multiple door joining assembly defined in claim 1 including:

said plurality of doors having a second secondary door residing adjacent said first mentioned secondary door;

an angle connecting plate assembly secured to said first secondary door and having a second cam follower outwardly projecting laterally therefrom; and said angle connecting plate assembly having a second roller disposed in a groove provided in a bottom of said second secondary door permitting movement of said secondary door with respect to said first mentioned secondary door and said primary door.

3. The multiple door joining assembly defined in claim 2 wherein:

a close-off panel carried on said second secondary door serving as a stop to restrict movement of said primary door.

4. The multiple door joining assembly defined in claim 3 wherein:

said first connecting plate assembly includes a flat plate having a cantilevered portion extending beneath said first mentioned secondary door;

said roller mounted on said cantilevered portion; and said angle connecting plate includes an "L" shaped plate with a laterally extending portion fixedly supporting said second roller.

5. The multiple door joining assembly defined in claim 4 including:

bumper pad fixtures secured to said first mentioned secondary door and said second secondary door for impacting against said stop panel.

6. The multiple sliding door arrangement comprising:

a plurality of sliding doors arranged in parallel spaced-apart relationship for movement relative to each other along a longitudinal direction;

said plurality of sliding doors having a primary door, a first secondary door and a second secondary door;

said first secondary door and said second secondary door having an elongated groove provided in a bottom of each first and second secondary doors;

a flat plate secured to a bottom of said primary door and said flat plate having an outwardly projecting portion;

a first roller carried on said flat plate outwardly projecting portion and movably received in said groove of said first secondary door so that primary door sliding actuates sliding of the first secondary door when the first roller contacts an end of the elongated groove in the first secondary door;

an angle plate secured to said first secondary door and with an outwardly projecting portion disposed beneath said bottom of said second secondary door; and a second roller carried on said outwardly projecting portion of said angle plate disposed in said groove of said second secondary door so that first secondary door sliding actuates sliding of the second secondary door when the second roller contacts an end of the elongated groove in the second secondary door;

said second secondary door having an installation aid fixedly secured to an outer edge thereof, at least a portion of the installation aid remaining reversibly extendable between retracted and extended positions to in the extended position engage a guide member for guiding the second secondary door during the sliding movement, the installation aid having a guide member-engaging portion longitudinally offset from said primary and secondary doors.

7. The multiple sliding door arrangement defined in claim 6 including:

a stop panel secured to said second secondary door for stopping sliding movement in a given direction of said plurality of sliding doors.

8. The multiple sliding door arrangement defined in claim 7 including:

bumper brackets secured in each of said grooves of said first secondary door and said second secondary door; and impact pads carried on said bumper brackets.

9. The multiple sliding door arrangement defined in claim 8 wherein:

the installation aid is carried on a selected end of said second secondary door and includes a guide roller pivotally carried thereon; and the guide member beneath said second secondary door includes a groove for insertably receiving said guide roller.

10. A multiple door joining assembly comprising:

a plurality of doors having a primary door and at least one secondary door movably suspended to be movable along a longitudinal direction;

a first connecting plate assembly secured to said primary door and having a cam follower outwardly projecting laterally to terminate with an upwardly projecting roller; and said at least one secondary door having a groove in a bottom thereof slidably accepting said roller so that sliding of the primary door in the longitudinal direction actuates sliding motion of the at least one secondary door in the longitudinal direction when the roller contacts an end of said groove in the at least one secondary door;

said secondary door having an installation aid coupled to an outer edge thereof, at least a portion of the installation aid being reversibly extendable between retracted and extended positions to in the extended position engage a guide member for guiding the secondary door during the sliding movement, the installation aid having a guide member-engaging portion longitudinally offset from said primary and secondary doors;

wherein the installation aid includes a portion pivotally displaceable between the retracted and extended positions.

11. A multiple sliding door arrangement comprising:

a plurality of sliding doors arranged in parallel spaced-apart relationship for movement relative to each other along a longitudinal direction;

said plurality of sliding doors having a primary door, a first secondary door and a second secondary door;

said first secondary door and said second secondary door having an elongated groove provided in a bottom of each first and second secondary doors;

a flat plate secured to a bottom of said primary door and said flat plate having an outwardly projecting portion;

a first roller carried on said flat plate outwardly projecting portion and movably received in said groove of said first secondary door so that primary door sliding actuates sliding of the first secondary door when the first roller contacts an end of the elongated groove in the first secondary door;

an angle plate secured to said first secondary door and with an outwardly projecting portion disposed beneath said bottom of said second secondary door; and a second roller carried on said outwardly projecting portion of said angle plate disposed in said groove of said second secondary door so that first secondary door sliding actuates sliding of the second secondary door when the second roller contacts an end of the elongated groove in the second secondary door;

said second secondary door having an installation aid coupled to an outer edge thereof, at least a portion of the installation aid being reversibly extendable between retracted and extended positions to in the extended position engage a guide member for guiding the second secondary door during the sliding movement, the installation aid having a guide member-engaging portion longitudinally offset from said primary and secondary doors;

wherein the installation aid includes a portion pivotally displaceable between the retracted and extended positions.

12. A multiple door joining assembly comprising:

a plurality of doors having a primary door and at least one secondary door movably suspended to be movable along a longitudinal direction;

adjacent ones of said primary and secondary doors being slidably coupled in relatively displaceable manner;

at least one said secondary door having an installation aid fixedly secured to an outer edge thereof, at least a portion of the installation aid remaining reversibly extendable between retracted and extended positions to in the extended position engage a guide member for guiding the secondary door during the sliding movement, the installation aid having a guide member-engaging portion longitudinally offset from said primary and secondary doors.

13. The multiple door joining assembly defined in claim 12, further comprising a close-off panel extending transversely outward from said secondary door for to define an access partition for said outer edge.

14. The multiple door joining assembly defined in claim 12, wherein the close-off panel is formed with an access opening for manually accessing the installation aid therethrough.

15. A multiple door joining assembly comprising:

a plurality of doors having a primary door and at least one secondary door movably suspended to be movable along a longitudinal direction;

adjacent ones of said primary and secondary doors being slidably coupled in relatively displaceable manner;

at least one said secondary door having an installation aid coupled to an outer edge thereof, at least a portion of the installation aid being reversibly extendable between retracted and extended positions to in the extended position engage a guide member for guiding the secondary door during the sliding movement, the installation aid having a guide member-engaging portion longitudinally offset from said primary and secondary doors;

wherein the installation aid is hingedly displaceable between the retracted and extended positions.

* * * * *